US009670612B2

(12) United States Patent
Lee et al.

(10) Patent No.: US 9,670,612 B2
(45) Date of Patent: Jun. 6, 2017

(54) LAUNDRY TREATMENT APPARATUS AND METHOD FOR CONTROLLING A LAUNDRY TREATMENT APPARATUS

(71) Applicant: LG ELECTRONICS INC., Seoul (KR)

(72) Inventors: Sangik Lee, Seoul (KR); Taegyu Jin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/820,629

(22) Filed: Aug. 7, 2015

(65) Prior Publication Data

US 2016/0047081 A1 Feb. 18, 2016

(30) Foreign Application Priority Data

Aug. 13, 2014 (KR) ..... 10-2014-0104891
Jun. 29, 2015 (KR) ..... 10-2015-0092469

(51) Int. Cl.
*D06F 58/20* (2006.01)
*D06F 58/28* (2006.01)

(52) U.S. Cl.
CPC ..... *D06F 58/206* (2013.01); *D06F 58/28* (2013.01); *D06F 2058/287* (2013.01);
(Continued)

(58) Field of Classification Search
CPC ..... F26B 21/00; F26B 21/06; D06F 58/00; D06F 58/12; D06F 58/20; D06F 58/206;
(Continued)

(56) References Cited

U.S. PATENT DOCUMENTS 4,621,438 A * 11/1986 Lanciaux ..... D06F 58/04 34/242
7,020,985 B2 * 4/2006 Casey ..... D06F 58/206 34/595

(Continued)

FOREIGN PATENT DOCUMENTS

CN 1724805 1/2006
CN 101725019 6/2010

(Continued)

OTHER PUBLICATIONS

European Search Report dated Nov. 4, 2015 issued in Application No. 15180779.9.

(Continued)

*Primary Examiner* — Stephen M Gravini
(74) *Attorney, Agent, or Firm* — Ked & Associates LLP

(57) ABSTRACT

A laundry treatment apparatus and a method for controlling a laundry treatment apparatus are provided. The method may include supplying alternating current at a predetermined first frequency to a compressor; measuring a first time a temperature of refrigerant discharged from the compressor; measuring a second time a temperature of the refrigerant discharged from the compressor, when a predetermined first reference time has passed after the measuring the first time of the temperature of the refrigerant discharged from the compressor; and controlling the first frequency of the alternating current based on a difference between the temperature measured the first time and the temperature measured the second time.

12 Claims, 6 Drawing Sheets

(52) U.S. Cl.
CPC ..... *D06F 2058/2854* (2013.01); *D06F 2058/2877* (2013.01); *D06F 2058/2896* (2013.01)

(58) Field of Classification Search
CPC ..... D06F 58/28; D06F 2058/287; D06F 2058/877
USPC ..... 34/267, 524, 595, 610, 596–609; 68/5 C, 68/5 R, 19, 20; 62/80
See application file for complete search history.

(56) References Cited

U.S. PATENT DOCUMENTS

| | | | | |
|---|---|---|---|---|
| 7,504,784 | B2 * | 3/2009 | Asada | D06F 37/304 318/400.02 |
| 8,424,347 | B2 * | 4/2013 | Maekawa | D06F 25/00 68/12.16 |
| 8,833,095 | B2 * | 9/2014 | Beers | D06F 58/206 62/238.1 |
| 9,097,462 | B2 * | 8/2015 | Lorenc | D06F 58/206 |
| 2011/0119952 | A1 | 5/2011 | Nawrot et al. | |
| 2011/0277334 | A1 * | 11/2011 | Lee | D06F 39/008 34/73 |
| 2011/0280736 | A1 * | 11/2011 | Lee | D06F 58/206 417/26 |
| 2015/0322616 | A1 * | 11/2015 | Dal Ben | D06F 58/28 34/560 |
| 2016/0036360 | A1 * | 2/2016 | Maekawa | H02M 7/53873 318/400.13 |
| 2016/0047081 | A1 * | 2/2016 | Lee | D06F 58/206 34/427 |
| 2016/0160427 | A1 * | 6/2016 | Lee | D06F 58/206 34/443 |

FOREIGN PATENT DOCUMENTS

| | | | | |
|---|---|---|---|---|
| CN | 102112677 | | 6/2011 | |
| CN | 102374699 | | 3/2012 | |
| DE | 10-2005-041145 | A1 | 3/2007 | |
| DE | 102005041145 | A1 * | 3/2007 | D06F 58/206 |
| EP | 2 077 350 | A1 | 7/2009 | |
| EP | 2690212 | A1 * | 1/2014 | D06F 58/206 |
| EP | 2 733 257 | A1 | 5/2014 | |
| EP | 2985384 | A1 * | 2/2016 | D06F 58/206 |
| JP | 2009-061163 | A | 3/2009 | |
| KR | 10-1235552 | | 2/2013 | |
| KR | 20140050981 | A * | 4/2014 | D06F 58/28 |
| WO | WO 2016021214 | A1 * | 2/2016 | B01D 53/26 |

OTHER PUBLICATIONS

Chinese Office Action dated Mar. 3, 2017 issued in Application No. 20151040137.4.

* cited by examiner

LAUNDRY TREATMENT APPARATUS AND METHOD FOR CONTROLLING A LAUNDRY TREATMENT APPARATUS

CROSS-REFERENCE TO RELATED APPLICATION(S)

This application claims priority to Korean Patent Application Nos. 10-2014-0104891, filed in Korea on Aug. 13, 2014, and 10-2015-0092469, filed in Korea on Jun. 29, 2015, which are hereby incorporated by reference as if fully set forth herein.

BACKGROUND

1. Field

A laundry treatment apparatus and a method for controlling a laundry treatment apparatus are disclosed herein.

2. Background

A laundry treatment apparatus is a generic term for electronic appliances that enable washing of laundry or other items (hereinafter collectively referred to as "laundry"), drying of laundry, and both washing and drying of laundry. A laundry treatment apparatus that enables drying of laundry may dry laundry by supplying hot air to a space in which the laundry is received. Some conventional laundry treatment apparatuses use a heat pump. The heat pump may include an evaporator that evaporates refrigerant via heat exchange with surrounding air, a condenser that heats surrounding air by condensing the refrigerant, and a compressor that compresses the refrigerant discharged from the evaporator and supplies the compressed refrigerant to the condenser.

Laundry treatment apparatuses using the heat pump have difficulty in achieving consistent drying performance because a temperature of air introduced to the evaporator may vary according to an environment in which the laundry treatment apparatus is located. That is, when the laundry treatment apparatus is operated at a low temperature, for example, when the laundry treatment apparatus is installed in a cold area or is operated during a cold season, a temperature of air introduced to the evaporator may be low, and therefore, it may take a long time to increase the temperature of air supplied to laundry to a desired level via the heat pump. This problematically increases a drying time, and consequently, increases power consumption of the laundry treatment apparatus.

When the laundry treatment apparatus is operated under high temperature conditions, for example, when the laundry treatment apparatus is installed in a hot area or is operated during a hot season, the temperature of air introduced to the evaporator may be high. This is advantageous from the aspect of increasing the temperature of air supplied to laundry to a desired level via the heat pump, but problematically increases a load on the compressor.

In addition, when the laundry treatment apparatus is installed in a high temperature or low temperature environment, a longer or shorter drying time may be required compared to a time required when the laundry treatment apparatus is operating under normal conditions (within a range from 18° C. to 25° C.), which causes variation in the drying time even though a same quantity of laundry is dried.

BRIEF DESCRIPTION OF THE DRAWINGS

Embodiments will be described in detail with reference to the following drawings in which like reference numerals refer to like elements, and wherein.

DETAILED DESCRIPTION

Figure 1:
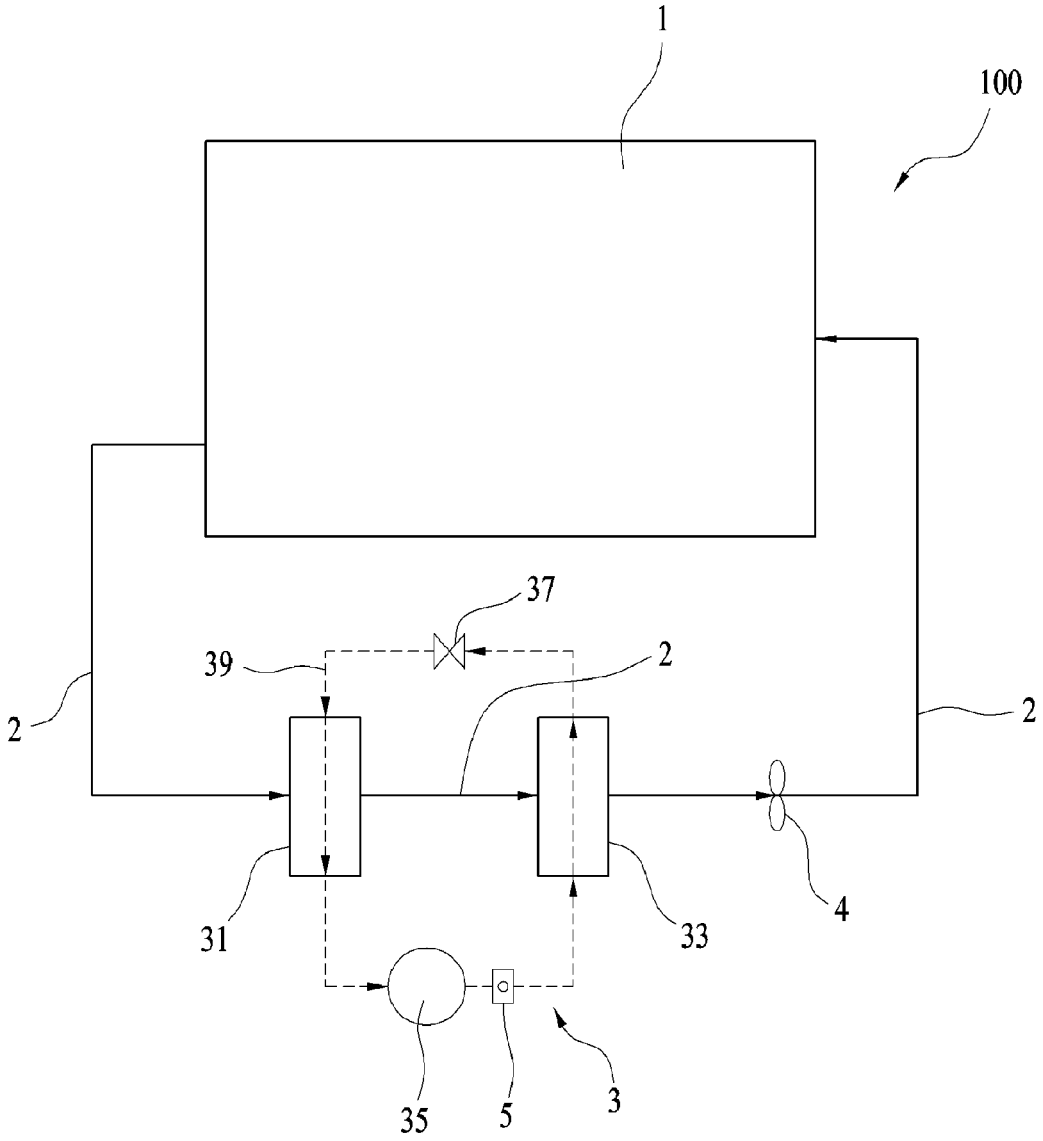
FIG. 1 is a schematic diagram of a laundry treatment apparatus according to an embodiment.
Figure 2A:
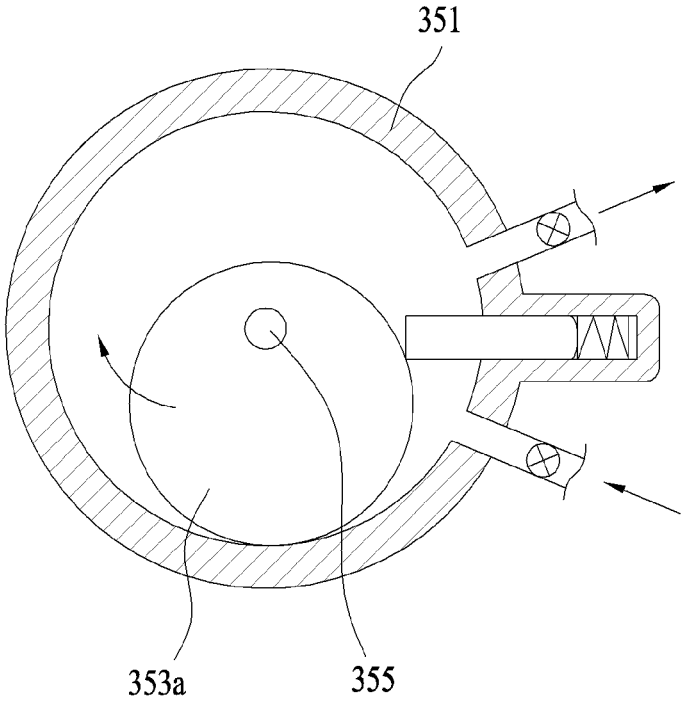
FIGS. 2A-2B are views illustrating different examples of a compressor according to embodiments.
Figure 2B:
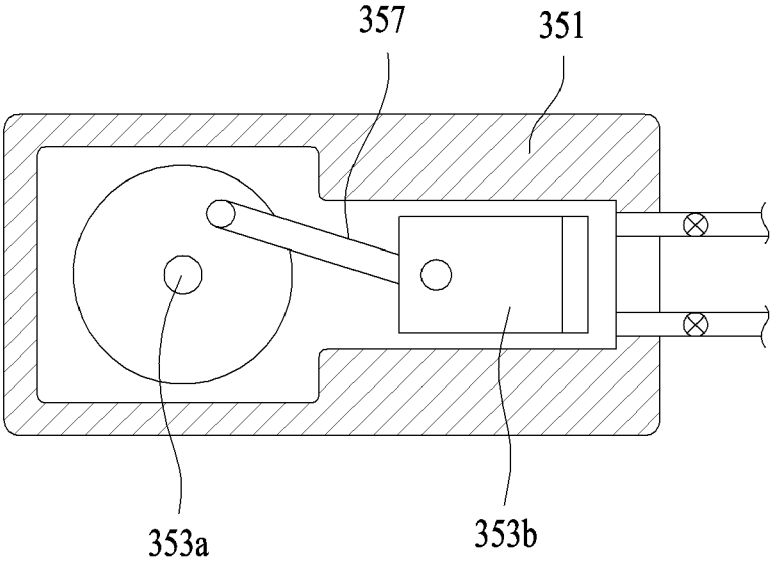
Figure 3:
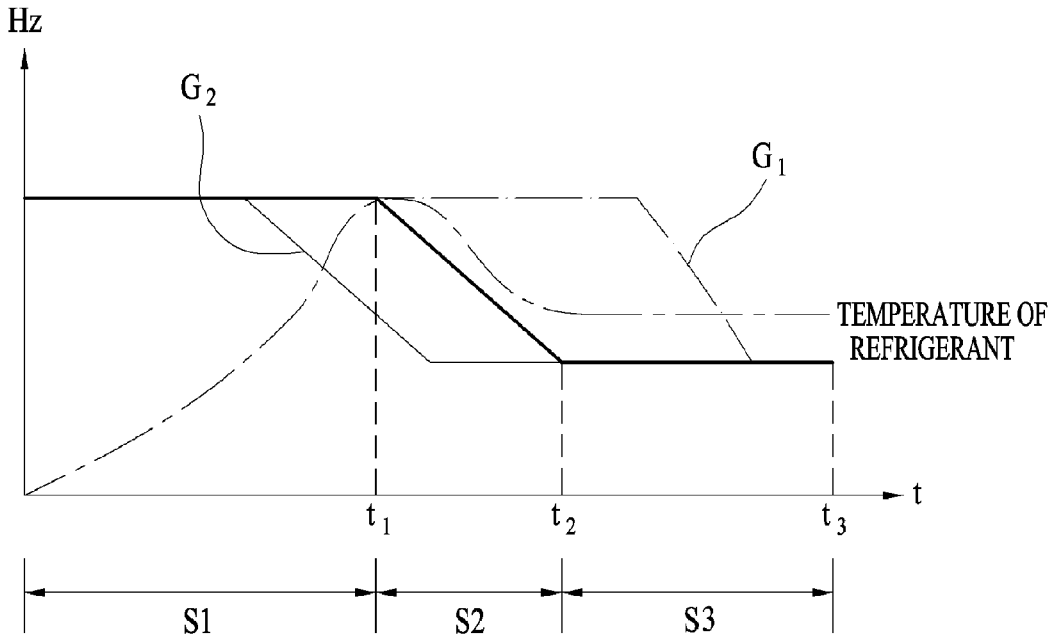
FIG. 3 is a graph illustrating a method for controlling a laundry treatment apparatus according to an embodiment.
Figure 4:
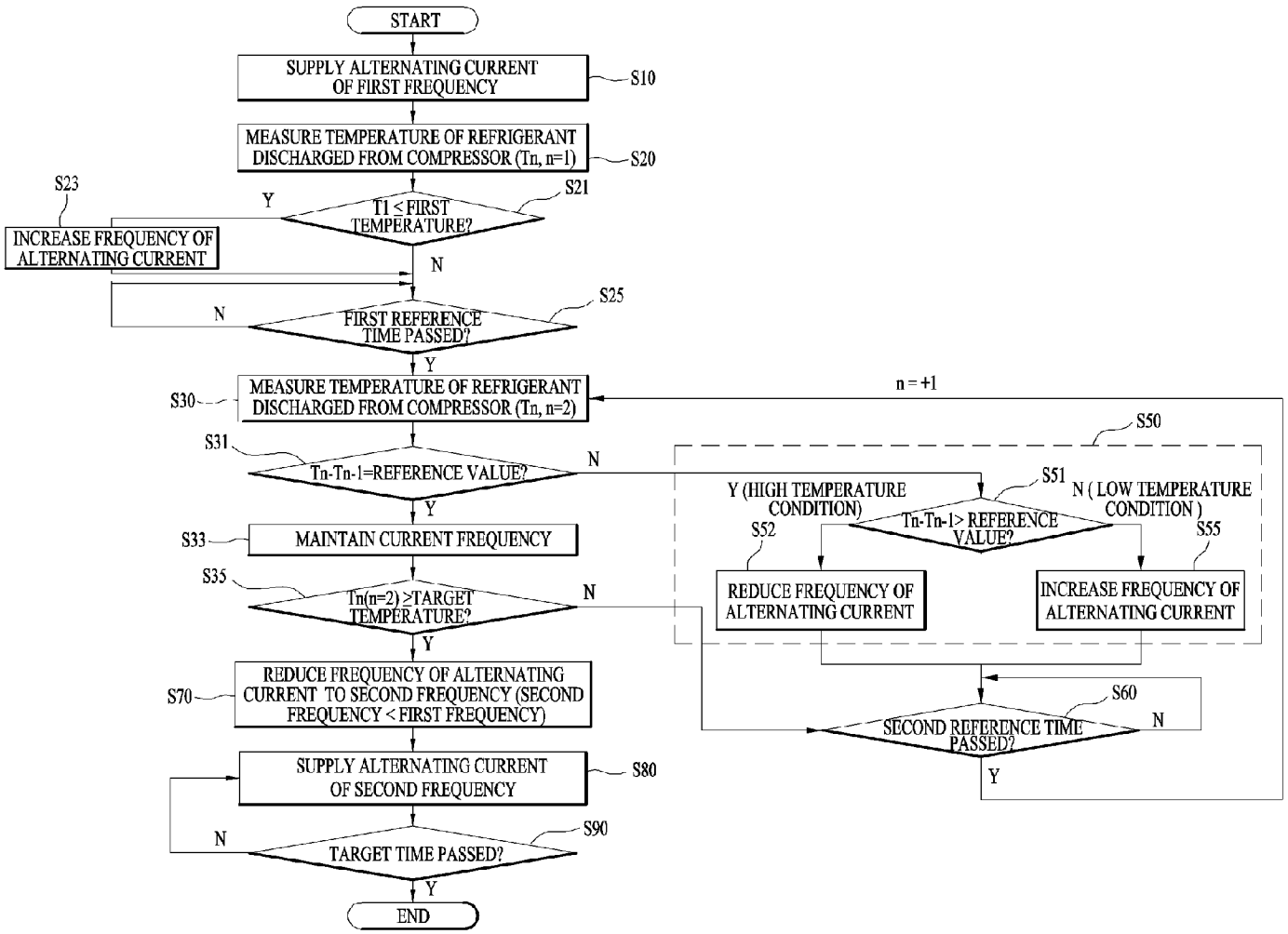
FIG. 4 is a flow chart of a method for controlling a laundry treatment apparatus according to an embodiment.
Figure 5A:
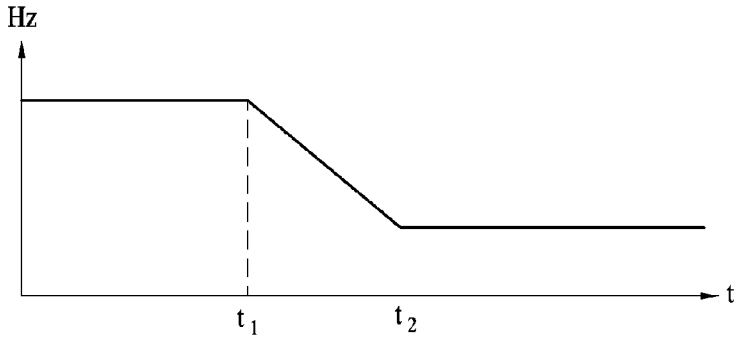
FIGS. 5A-5C are graphs illustrating adjustment of a time point at which a refrigerant discharged from a compressor reaches a target temperature according to a method for controlling a laundry treatment apparatus according to an embodiment.
Figure 5B:
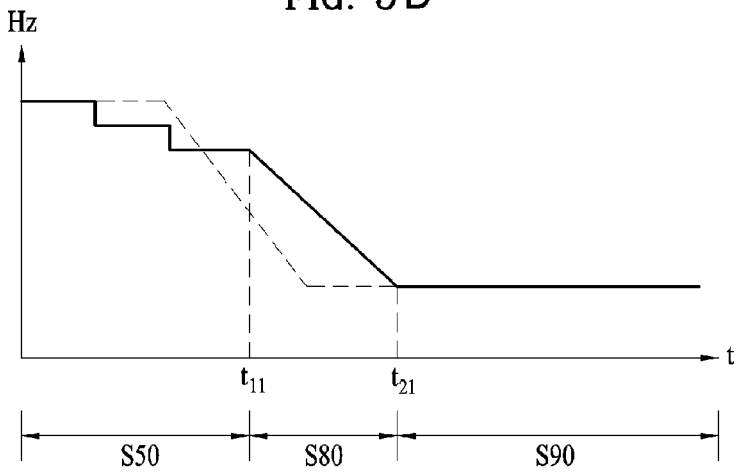
Figure 5C:
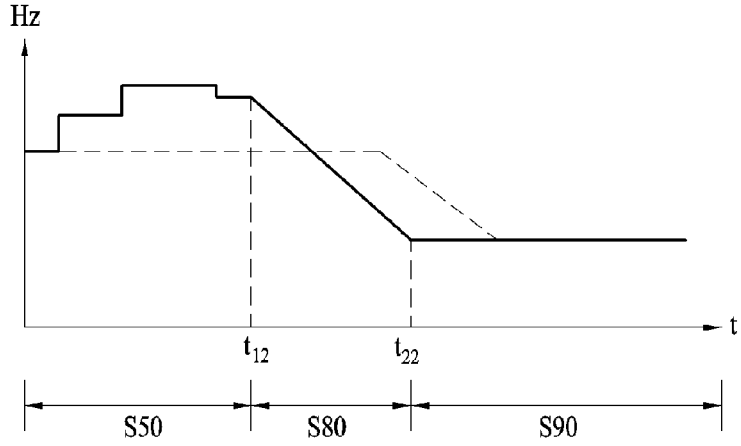

FIG. 1 is a schematic diagram of a laundry treatment apparatus according to an embodiment. FIGS. 2A-2B are views illustrating different examples of a compressor according to embodiments. FIG. 3 is a graph illustrating a method for controlling a laundry treatment apparatus according to an embodiment. FIG. 4 is a flow chart of a method for controlling a laundry treatment apparatus according to an embodiment; FIGS. 5A-5C are graphs illustrating adjustment of a time point at which a refrigerant discharged from a compressor reaches a target temperature according to a method for controlling a laundry treatment apparatus according to an embodiment.

The laundry treatment apparatus 100 of FIG. 1 may include a receiving unit or receiver 1 that provides a space in which an object to be dried, such as laundry, may be received, a circulation flow path 2 and a fan 4 that circulates air inside of the receiver 1, a heat pump 3 that performs heat exchange with air introduced to the circulation flow path 2, and a temperature sensor 5 to measure a temperature of a refrigerant that serves as a heat exchange fluid of the heat pump 3. The receiver 1 may have any shape as long as it can receive an object to be dried.

Air discharged from the receiver 1 may flow along the circulation flow path 2 and then be reintroduced to the receiver 1. The fan 4 may be provided inside of the circulation flow path 2 to circulate the air from the receiver 1 through the circulation flow path 2.

The heat pump 3 may dehumidify and heat the air inside of the circulation flow path 2. The heat pump 3 may include an evaporator 31, a compressor 35, a condenser 33, an expander 37, and a refrigerant pipe 39.

The refrigerant pipe 39 may provide a flow path for circulation of the refrigerant. The refrigerant pipe 39 may extend between the evaporator 31 and the compressor 35, between the compressor 35 and the condenser 33, between the condenser 33 and the expander 37, and between the expander 37 and the evaporator 31.

The evaporator 31 may perform heat exchange between the air introduced to the circulation flow path 2 and the refrigerant. The air passing through the evaporator 31 may be cooled, whereas the refrigerant passing through the evaporator 31 may be evaporated by absorbing heat from the air. In this way, moisture contained in the air may be removed while the air passes through the evaporator 31.

The compressor 35 may compress the refrigerant. The compressor 35 may be provided between the evaporator 31 and the condenser 33. As such, the compressor 35 may compress the refrigerant discharged from the evaporator 31 through the refrigerant pipe 39 and direct the compressed refrigerant to the condenser 33. In this case, the temperature sensor 5, provided to measure the temperature of the refrigerant, may measure the temperature of the refrigerant discharged from the compressor 35.

The temperature of the refrigerant discharged from the compressor 35 may be measured in various ways. The temperature sensor 5 according to this embodiment may function to estimate the temperature of the refrigerant by measuring a temperature of the refrigerant pipe 39, or may function to directly measure the temperature of the refrigerant.

In this embodiment, the reason why the temperature sensor 5 is provided to measure the temperature of the refrigerant discharged from the compressor 35 is because controlling the temperature of the refrigerant to be supplied to the condenser 33 is the most advantageous way to control the temperature of hot air to be supplied to the receiver 1. As the air introduced to the circulation flow path 2 may be heated while passing through the condenser 33, the temperature of the air to be supplied to the receiver 1 may be directly affected by the temperature of the refrigerant supplied to the condenser 33. Accordingly, when the temperature sensor 5 is provided to measure the temperature of the refrigerant discharged from the compressor 35, the temperature of the air to be supplied to the receiver 1 may be more easily controlled compared to a case in which the temperature sensor 5 is provided to measure the temperature of the refrigerant to be introduced to the compressor 35 or to measure the temperature of the refrigerant to be introduced to the evaporator 31.

The condenser 33 may perform heat exchange between the refrigerant and the air (dehumidified air) having passed through the evaporator 31. The air having passed through the condenser 33 may be heated, whereas the refrigerant passing through the condenser 33 may be condensed by radiating heat to the air. The expander 37 may reduce a pressure of the refrigerant moving from the condenser 33 to the evaporator 31 through the refrigerant pipe 39.

As exemplarily illustrated in FIG. 2, although the compressor 35 may be classified in various manners according to a refrigerant compression method thereof, the compressor 35 may include a housing 351 that provides a refrigerant storage space, a pressure member that compresses the refrigerant by rotating or rectilinearly reciprocating inside the housing 351, so as to discharge the refrigerant from the housing 351, and a drive 355, for example, a motor, that adjusts revolutions per minute (RPM) of a rotating pressure member 353*a* or a reciprocation period of a rectilinearly reciprocating pressure member 353*b*.

When the pressure member 353*a* rotates, the pressure member 353*a* may compress the refrigerant by reducing a volume of the refrigerant until the refrigerant introduced to the housing 351 is discharged from the housing 351. As such, a flow rate of the refrigerant discharged from the housing 351 may be controlled by the RPM of the drive 355. When the pressure member 353*b* rectilinearly reciprocates, the pressure member 353*b* and the drive 355 need to be connected to each other via a component 357, for example, a power converter that converts rotation of the drive 355 into rectilinear reciprocation of the pressure member 353*b*. As such, in a case of the compressor 35 including the pressure member 353*b* that rectilinearly reciprocates, a flow rate of the refrigerant may be controlled via control of the RPM of the drive 355.

In addition, the RPM of the drive 355 included in the compressor 35 may be controlled by controlling a frequency of alternating current supplied to the drive 355. Therefore, the flow rate of the refrigerant discharged from the compressor 35 may be controlled using the frequency of the alternating current supplied to the drive 355.

In operating the laundry treatment apparatus 100 having the above-described configuration, a controller (not illustrated) may operate the fan 4 when a user inputs a control command to the laundry treatment apparatus 100. When the fan 4 is operated, interior air of the receiver 1, that is, the air inside of the receiver 1, may be introduced into the circulation flow path 2 and then resupplied to the receiver 1 after passing through the evaporator 31 and the condenser 33. During this circulation of the interior air of the receiver 1, the controller (not illustrated) may control the frequency of the alternating current supplied to the compressor 35, as exemplarily illustrated in FIG. 3.

That is, the controller (not illustrated) may control the compressor 35 via three steps or operations. The three steps or operations may include operating the compressor 35 by supplying alternating current of a first frequency to the compressor 35 (S1), reducing the frequency of the alternating current supplied to the compressor 35 to a second frequency (lower than the first frequency) once the temperature of the refrigerant discharged from the compressor 35 and measured by the temperature sensor 5 has reached a target temperature (S2), and operating the compressor 35 at the second frequency (S3).

To efficiently dry an object to be dried, such as laundry, the temperature of the refrigerant supplied to the condenser 33, that is, the temperature of the refrigerant discharged from the compressor 35, needs to be a given temperature or target temperature, required to heat the air passing through the condenser 33, or higher. Accordingly, increasing the flow rate of the refrigerant by increasing the frequency of the alternating current, that is, the RPM of the drive 355 (S1) may move up a point in time $t_1$, which is a target temperature reaching time point, at which the temperature of the refrigerant supplied to the condenser 33 reaches a target temperature.

That is, the alternating current supplied to the compressor 35 may be maintained at a high frequency (first frequency) in order to reduce the time taken for the refrigerant to reach a predetermined target temperature (S1). The alternating current supplied to the compressor 35 may be maintained at a constant frequency (second frequency) in order to maintain the refrigerant at a temperature suitable for drying laundry (S3). The frequency of alternating current supplied to the compressor 35 may be reduced from the first frequency to the second frequency once the refrigerant has reached the target temperature, in order to minimize noise and a load on the compressor 35 (S2). However, the operation method of the compressor 35 as described above has a disadvantage in a drying time varies according to a temperature around the laundry treatment apparatus 100.

First, a case in which the temperature around the laundry treatment apparatus 100 is lower than normal will be described hereinafter. When the laundry treatment apparatus 100 is operating under low temperature conditions, for example, when the laundry treatment apparatus 100 is operated in a cold area or during a cold season, the evaporator 31 may absorb less heat because the temperature of the air introduced into the circulation flow path 2 is low. Accordingly, a point in time at which the refrigerant discharged from the compressor 35 reaches the target temperature when the temperature around the laundry treatment apparatus 100 is low will be delayed (G1) compared to a point in time $t_1$ at which the refrigerant reaches the target temperature under normal conditions. When the point in time at which the refrigerant discharged from the compressor 35 reaches the target temperature is delayed, a drying time may be increased and the laundry treatment apparatus 100, which has a preset or predetermined drying end time point $t_3$, may fail to sufficiently dry an object to be dried.

When the temperature around the laundry treatment apparatus 100 is higher than normal, for example, when the laundry treatment apparatus is operating under high temperature conditions, that is, operated in a hot area or during a hot season, the evaporator 31 may absorb more heat because the temperature of the air introduced into the circulation flow path 2 is high. Accordingly, a point in time at which the refrigerant discharged from the compressor 35 reaches the target temperature will be moved up (G2) compared to the point in time $t_1$ at which the refrigerant reaches the target temperature under normal conditions. When the point in time at which the refrigerant discharged from the compressor 35 reaches the target temperature is moved up, the laundry treatment apparatus, which has the preset or predetermined drying end time point $t_3$, may suffer from wasted energy, and in some cases, the laundry treatment apparatus may fail to sufficiently dry an object to be dried despite an increase in the implementation time of the third step or operation S3. That is, the method as illustrated in FIG. 3 has difficulty in maintaining a constant drying time according to the temperature in the environment surrounding the location in or at which the laundry treatment apparatus is located.

To solve the problem described above, method for controlling a laundry treating apparatus according to embodiments may be implemented, as illustrated in FIG. 4.

FIG. 4 is a flow chart of a method for controlling a laundry treatment apparatus according to an embodiment. When a command to execute a drying course is input to the laundry treatment apparatus 100, the method of FIG. 4 may proceed to supplying alternating current of a predetermined first frequency to the compressor 35 (first drive), in step or operation S10, and measuring the temperature of the refrigerant discharged from the compressor 35 (primary temperature measurement), in step or operation S20. When step S20 is completed, the method may measure the temperature of the refrigerant discharged from the compressor 35 (secondary temperature measurement), in step or operation S30 (n=2), when a first reference time has passed, in step or operation S25. Then, the method of FIG. 4 may judge whether a value acquired by subtracting the temperature of the refrigerant measured in step S20 from the temperature of the refrigerant measured in step S30 is equal to a predetermined reference value, in step or operation S31.

The method of FIG. 4 may control the first frequency (first frequency control) based on the difference between the temperature of the refrigerant measured in step S20 and the temperature of the refrigerant measured in step S30, in step or operation S33 or S50. This first frequency control may maintain or change the frequency of the alternating current supplied to the compressor 35 based on a predetermined condition.

When the value acquired by subtracting the temperature of the refrigerant measured in step S20 from the temperature of the refrigerant measured in step S30 is equal to the reference value, the first frequency control may include maintaining the current frequency (first frequency) of the alternating current being supplied to the compressor 35, in step or operation S33, and judge whether the temperature of the refrigerant measured in step S30 has reached a predetermined target temperature, in step or operation S35 (e.g., within a range of 67 to 71° C.). The reference value may be set based on data related to an increased amount of the temperature of the refrigerant or a rate of increase of the temperature.

That the difference between the temperature of the refrigerant measured in step S20 and the temperature of the refrigerant measured in step S30 is equal to the reference value means that the rate of increase of the temperature of the refrigerant corresponds to the predetermined condition. That is, this means that the laundry treatment apparatus is operating under normal conditions. In addition, that the temperature of the refrigerant measured in the secondary temperature measurement has reached the predetermined target temperature means that the temperature of air heated via heat exchange with the refrigerant has been raised to the temperature suitable for drying laundry.

When the temperature of the refrigerant measured in step S30 is the target temperature or higher, the method of FIG. 4 may reduce the frequency of the alternating current supplied to the compressor 35 to the second frequency, in step or operation S70. Then, the method may continuously supply the second frequency of the alternating current to the compressor 35 (second drive), in step or operation S80. During step S80, the method of FIG. 4 may periodically judge whether a preset or predetermined target time for the drying course has passed, in step or operation S90, and end the drying course when the target time has passed.

However, when the value, acquired by subtracting the temperature of the refrigerant measured in step S20 (primary temperature measurement) from the temperature of the refrigerant measured in step S30 (second temperature measurement), is not equal to the reference value, the first frequency control may adjust the frequency of the alternating current supplied to the compressor 35 (primary adjustment), in step or operation S50.

When the value, acquired by subtracting the temperature of the refrigerant measured in step S20 from the temperature of the refrigerant measured in step S30, is greater than the reference value, step S50 may reduce the frequency of the alternating current supplied to the compressor 35, in step or operation S52.

Step S52 may supply the alternating current, having a frequency lower than the first frequency by a predetermined reference frequency, to the compressor 35. That is, step S52 may supply the alternating current, having a frequency lower than the first frequency and higher than the second frequency, to the compressor 35. That the value, acquired by subtracting the temperature of the refrigerant measured in step S20 from the temperature of the refrigerant measured in step S30, is greater than the reference value may be understood as the laundry treatment apparatus being operated under high temperature conditions.

The rate of increase of the temperature of the refrigerant under high temperature conditions is greater than the rate of increase of the temperature of the refrigerant under normal conditions. In turn, the greater rate of increase of the temperature of the refrigerant means that a shorter time is taken for the refrigerant to reach a target temperature than under normal conditions. Accordingly, step S52 may serve to delay the time taken for the refrigerant to reach the target temperature.

When the value, acquired by subtracting the temperature of the refrigerant measured in step S20 from the temperature of the refrigerant measured in step S30, is smaller than the reference value, step S50 may increase the frequency of the alternating current supplied to the compressor 35, in step or operation S55. Step S55 may supply the alternating current, having a frequency higher than the first frequency by the reference frequency, to the compressor 35. That the value, acquired by subtracting the temperature of the refrigerant measured in step S20 from the temperature of the refrigerant measured in step S30, is smaller than the reference value may be understood as the laundry treatment apparatus being operated under low temperature conditions.

The rate of increase of the temperature of the refrigerant under low temperature conditions is smaller than the rate of increase of the temperature of the refrigerant under normal conditions. In turn, the smaller rate of increase of the temperature of the refrigerant means that a longer time is taken for the refrigerant to reach the target temperature than that under normal conditions. Accordingly, step S55 may serve to shorten the time taken for the refrigerant to reach the target temperature.

When step S50 (primary adjustment) described above is completed, the method of FIG. 4 may proceed to step S30 (n=3) of measuring the temperature of the refrigerant discharged from the compressor 35 (tertiary temperature measurement). Step S30 (n=3) may be performed when a predetermined second reference time has passed, in step or operation S60, from the point in time at which step S30 (n=2) is completed.

Step S30 (n=3) may also be performed upon judging that the temperature measured in step S30 has not reached the target temperature, in step or operation S35 even if the value, acquired by subtracting the temperature of the refrigerant measured in step S20 from the temperature of the refrigerant measured in step S30, is equal to the reference value. When the temperature of the refrigerant discharged from the compressor 35 is measured via step S30 (n=3), the method of FIG. 4 may judge whether the difference between the temperature of the refrigerant measured in step S30 (n=3) and the temperature of the refrigerant measured in step S30 (n=2) is equal to the reference value, in step or operation S31.

When the difference between the temperature of the refrigerant measured in step S30 (n=3) and the temperature of the refrigerant measured in step S30 (n=2) is equal to the reference value, the method of FIG. 4 may maintain the alternating current supplied to the compressor 35 at the second frequency, in step or operations S70 and S80, based on whether the temperature of the refrigerant measured step S30 (n=3) has reached the target temperature, in step or operation S35. When a preset or predetermined target time for the drying course has passed, in step or operation S90, the method of FIG. 4 may end the drying course. However, when the difference between the temperature of the refrigerant measured in step S30 (n=3) and the temperature of the refrigerant measured in step S30 (n=2) is not equal to the reference value, the method of FIG. 4 may again proceed to step S50.

When the difference between the temperature of the refrigerant measured in step S30 (n=3) and the temperature of the refrigerant measured in step S30 (n=2) is greater than the reference value, step S50 may reduce the current frequency, that is, the first frequency or the frequency adjusted via the primary adjustment step, of the alternating current supplied to the compressor 35 by the reference frequency, in step or operation S52. When the difference between the temperature of the refrigerant measured in step S30 (n=3) and the temperature of the refrigerant measured in step S30 (n=2) is smaller than the reference value, step S50 may increase the current frequency, that is, the first frequency or the frequency adjusted via the primary adjustment of the alternating current supplied to the compressor 35 by the reference frequency, in step or operation S55.

Step S50 may be repeated until the difference between the two temperatures of the refrigerant, measured at different times, is equal to the reference value, in step or operation S31. Accordingly, when a value, acquired by subtracting the temperature of the refrigerant measured in step S30 (n=3) from the temperature of the refrigerant measured after completion of step S50, differs from the reference value, the method of FIG. 4 may proceed to a tertiary adjustment step.

However, when the value, acquired by subtracting the temperature of the refrigerant measured in step S30 (n=3) from the temperature of the refrigerant measured after completion of step S50, is equal to the reference value, and the temperature of the refrigerant measured after completion of step S50 has reached the target temperature, in step or operation S35, the method of FIG. 4 may end the drying course according to a given condition, in step or operation S90, after supplying the second frequency of the alternating current to the compressor 35, in steps or operations S70 and S80.

Through the process described above, embodiments disclosed herein may provide a method for controlling a laundry treatment apparatus which makes variation in temperature of refrigerant, which circulates under high temperature or low temperature conditions, to be the same as a variation in temperature of refrigerant, which circulates under normal conditions, within a short time.

As described above, when the laundry treatment apparatus 100 is exposed to a high temperature, the point in time at which the refrigerant discharged from the compressor 35 reaches the target temperature may be moved up compared to the point in time at which the refrigerant reaches the target temperature under normal conditions. Accordingly, step S52 may delay the point in time ($t_{11}$, FIG. 5C) at which the refrigerant discharged from the compressor 35 reaches the target temperature by reducing a flow rate of the refrigerant, thereby allowing the point in time $t_{11}$ to be equal or similar to the point in time ($t_1$, FIG. 5A) at which the refrigerant reaches the target temperature under normal conditions.

When the value, acquired by subtracting the temperature of the refrigerant measured in step S20 from the temperature of the refrigerant measured in step S30, is smaller than the predetermined reference value, the controller (not illustrated) may judge that the laundry treatment apparatus 100 is exposed to a low temperature and increase the frequency of the alternating current supplied to the compressor 35, in step or operation S55. In step S55, alternating current having a frequency which is higher than the first frequency by the reference frequency, for example, 2 Hz, may be supplied to the compressor 35.

When the laundry treatment apparatus 100 is exposed to a low temperature, the point in time at which the refrigerant discharged from the compressor 35 reaches the target temperature may be delayed compared to the point in time at which the refrigerant reaches the target temperature under normal conditions. Accordingly, step S55 may move up the point in time ($t_{12}$, FIG. 5C) at which the refrigerant discharged from the compressor 35 reaches the target temperature by increasing the flow rate of the refrigerant, thereby allowing the point in time $t_{12}$ to be equal or similar to the point in time ($t_1$, FIG. 5A) at which the refrigerant reaches the target temperature under normal conditions.

To facilitate easier control of the point in time at which the refrigerant discharged from the compressor 35 reaches the target temperature regardless of the temperature around the laundry treatment apparatus 100, step S50 as described above may be repeatedly performed until the refrigerant discharged from the compressor reaches the target temperature. That is, the method of FIG. 4 may further include measuring the temperature of the refrigerant discharged from the compressor 35 again after completion of step S50 (third temperature measurement), in step or operation S30 (n=3).

Step S30 may be performed when a predetermined second reference time has passed, in step or operation S60, as the point in time at which step S30 is completed. When the temperature of the refrigerant measured in step S30 has not reached the target temperature, the method of FIG. 4 may further proceed to step S50 (secondary adjustment), as described above.

Unlike the primary adjustment step, the secondary adjustment may be performed by comparing the difference between the temperature of the refrigerant measured in the tertiary temperature measurement, step S30 (n=3), and the temperature of the refrigerant measured in the secondary temperature measurement, step S30 (n=2), with the reference value. When the difference between the temperature of the refrigerant measured in the tertiary temperature measurement, step S30 (n=3), and the temperature of the refrigerant measured in the secondary temperature, measurement step S30 (n=2), is equal to the reference value, in the secondary adjustment, the current frequency of the alternating current supplied to the compressor 35, that is, the frequency acquired after the primary adjustment, the first frequency, or the adjusted frequency, will be maintained. However, when the difference between the temperature of the refrigerant measured in the tertiary temperature measurement, step S30 (n=3), and the temperature of the refrigerant measured in the secondary temperature measurement, step S30 (n=2), is greater than the reference value, in the secondary adjustment, the frequency of the alternating current supplied to the compressor 35, that is, the frequency acquired after the primary adjustment, may be reduced by the reference frequency, in step S52.

When the difference between the temperature of the refrigerant measured in the tertiary temperature measurement, step S30 (n=3), and the temperature of the refrigerant measured in the secondary temperature measurement, step S30 (n=2), is smaller than the reference value, in the secondary adjustment, the frequency of the alternating current supplied to the compressor 35, that is, the frequency acquired after the primary adjustment, may be increased by the reference frequency, in step S55. When the temperature of the refrigerant measured in the tertiary temperature measurement, step S30 (n=3), reaches the target temperature, in step or operation S40, the method of FIG. 4 may reduce the frequency of the alternating current supplied to the compressor 35 to the second frequency, in step or operation S70, and continuously supplying the second frequency of the alternating current to the compressor 35, in step or operation S80.

Step S70 reduces the current frequency of the alternating current being supplied to the compressor 35, that is, the frequency acquired after the primary adjustment step, to the second frequency. In this case, in this embodiment, the current frequency of the alternating current being supplied to the compressor 35 may be reduced by a constant magnitude per a given time such that the frequency of the alternating current supplied to the compressor 35 becomes the second frequency. That is, the controller (not illustrated) may reduce the frequency of the alternating current, adjusted via step S50 (primary adjustment), by 1 Hz every four minutes, such that the frequency of the alternating current supplied to the compressor 35 becomes the second frequency. This serves to prevent generation of excessive load in the compressor 35.

During step S80 (second drive), the method of FIG. 4 may periodically judge whether a preset or predetermined target time for the drying course has passed, in step or operation S90, and end the drying course when the target time has passed.

Accordingly, in this embodiment, as step S50 is repeatedly executed based on an increase in the temperature of the refrigerant discharged from the compressor 35, the point in time at which the temperature of the refrigerant reaches the target temperature may be maintained constant, or may be within a given deviation regardless of the temperature around the laundry treatment apparatus 100. In this way, embodiments may maintain a same or similar drying time regardless of the current frequency of the alternating current being supplied to the compressor 35 under a condition that a quantity of laundry is the same.

The method of FIG. 4 may judge whether the temperature of the refrigerant measured in step S20 (primary temperature measurement) is a predetermined first temperature, which may be lower than the target temperature, or lower, in step or operation S21, and increase the frequency of the alternating current supplied to the compressor 35, in step or operation S23. That the initially measured temperature of the refrigerant after operation of the compressor 35 has not reached the predetermined first temperature may be understood as the laundry treatment apparatus 100 being in operation under low temperature conditions. Accordingly, when the compressor 35 is operated before step S50 (primary adjustment) after the flow rate of the refrigerant is increased, this is advantageous from the aspect of controlling the drying time of the laundry treatment apparatus 100 which is operating under low temperature conditions.

The laundry treatment apparatus including the heat pump may be typically designed based on operation thereof at room temperature (under normal conditions, within a range from 18° C. to 25° C.). This is because the compressor has a high efficiency at room temperature, which is advantageous for drying laundry. Meanwhile, the temperature of air that enables effective drying of laundry without damage to the laundry is within a range from 60° C. to 70° C. As described above, the temperature of air supplied to the laundry may be measured by directly measuring the temperature of air supplied to the receiver in which the laundry is stored, or may be estimated by measuring the temperature of the refrigerant. In a case of the latter, the temperature of the refrigerant may be measured, for example, at an exit side of the compressor, an exit side of the evaporator, and an exit side of the condenser. The temperatures of the refrigerant, measured, respectively, at the exit side of the compressor, the exit side of the evaporator, and the exit side of the condenser, differ for physical reasons.

The temperature of the refrigerant measured at the exit side of the compressor may represent a reliability of the compressor included in the heat pump, and consequently, may be considered as representing a reliability of the entire laundry treatment apparatus system. The temperature of the refrigerant measured at the exit side of the evaporator or the exit side of the condenser may be mainly utilized to judge a degree of overheating or a degree of overcooling of the system. Embodiments disclosed herein are intended to reduce drying time by adjusting the RPM of the compressor while maintaining system reliability, and therefore, the temperature sensor (5, see FIG. 1) used to measure the temperature of the air supplied to the receiver may be provided to measure the temperature of the refrigerant at the exit side of the compressor.

When a drying course input by a user is initiated, the refrigerant begins to circulate, attributable to the compressor. As the system has not yet warmed up at the beginning of the drying course (this is a state in which energy supplied to the heat pump is not used to raise the temperature of the refrigerant, but rather, is used to raise a temperature of component elements of the laundry treatment apparatus or a temperature of a space in which the heat pump is installed), the temperature of the refrigerant at the exit side of the compressor slowly increases as time passes. Thereafter, in the embodiment disclosed herein, the RPM of the compressor may be gradually reduced starting from the point in time at which air having a temperature suitable for drying can be supplied based on measurement of the temperature of the refrigerant at the exit side of the compressor. For example, the RPM of the compressor may be gradually reduced starting from the point in time at which the temperature of the refrigerant at the exit side of the compressor is approximately 69° C. The reason for reducing the RPM of the compressor after the specific point in time is to prevent overload of the compressor and to prevent an unnecessary increase in the temperature of the air via adjustment of the flow rate of the refrigerant.

When the laundry treatment apparatus is operated at a low temperature, that is, a temperature lower than room temperature, the temperature around the compressor will also be lower than room temperature. Thus, it will take longer to warm-up the system than at room temperature, which means it will take longer to raise the temperature of the air to the temperature suitable for drying. That is, a larger amount of time is required to raise the temperature of the air, and correspondingly, the drying time may be increased.

On the other hand, when the temperature around the system is higher than room temperature, that is, under high temperature conditions, the temperature around the compressor will be higher than room temperature. Thus, although the temperature of the compressor is rapidly raised once the drying course has begun, the temperature of the air may not be raised as much as that of the compressor.

That is, even if the temperature of the refrigerant is rapidly raised to a predetermined temperature, the temperature of the air supplied to the receiver may occasionally not be raised to the temperature suitable for drying. This phenomenon occurs because the temperature of the air introduced to the receiver, for example, a drum, is indirectly inferred based on the temperature of the refrigerant. Therefore, as the temperature of the air supplied to the receiver is lower than the temperature suitable for drying even if the laundry treatment apparatus is operated at a high temperature and the time taken for the refrigerant to reach a target temperature is shortened, the high temperature may also cause an increase in the drying time.

Figure 6:
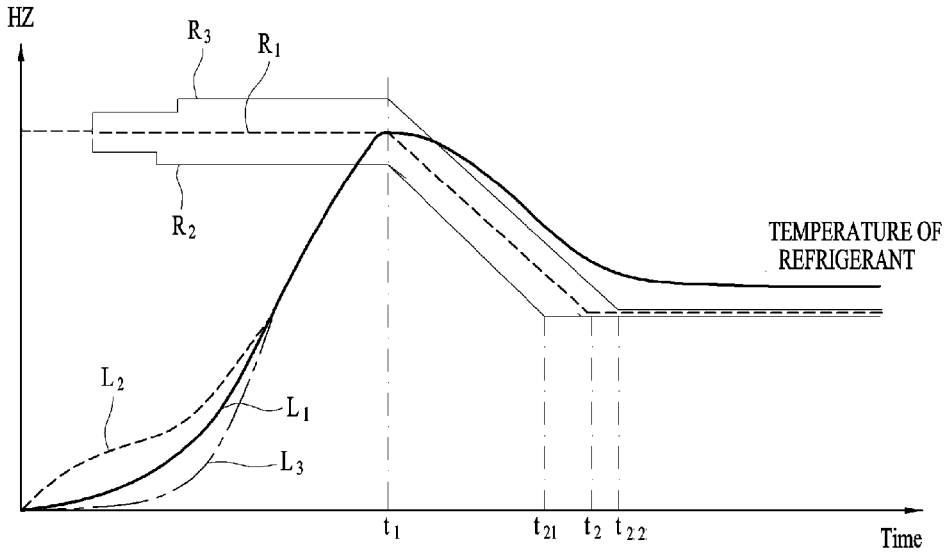
FIG. 6 is a graph illustrating variation in temperature of refrigerant when a compressor is controlled according to a method for controlling a laundry treating apparatus according to embodiments disclosed herein.

FIG. 6 is a graph illustrating variation in temperature of refrigerant when a compressor is controlled according to a method for controlling a laundry treating apparatus according to embodiments disclosed herein. In the embodiments disclosed herein, the same frequency (first frequency) of alternating current is supplied to the compressor upon the initial stage of operation of the laundry treatment apparatus, regardless of whether the laundry treatment apparatus is operating under normal conditions, low temperature conditions, or high temperature conditions. When the laundry treatment apparatus is operating under normal conditions, in embodiments disclosed herein, the first frequency of the alternating current will be continuously supplied to the compressor until the refrigerant reaches a target temperature at time $t_1$. Therefore, the frequency of the alternating current supplied to the compressor under normal conditions is equal to a value $R_1$ and the temperature of the refrigerant will vary as represented by $L_1$. Once the temperature of the refrigerant has reached the target temperature at time $t_1$, in embodiments disclosed herein, the temperature of the refrigerant may be lowered to a value at time $t_2$ corresponding to the second frequency and the laundry treatment apparatus may be operated until an operation time of the laundry treatment apparatus reaches a target time.

When the laundry treatment apparatus is operating under low temperature conditions, the rate of increase of the temperature of the refrigerant (represented by $L_3$), that is, the difference between the two temperatures of the refrigerant measured at different times with a first reference time interval, may be smaller than the rate of increase of the temperature of the refrigerant under normal conditions. In this case, as at least one adjustment may be performed to increase the frequency of the alternating current supplied to the compressor to a value $R_3$ until the two temperatures of the refrigerant measured at different times reach reference values, embodiments disclosed herein may control variation in the temperature of refrigerant, which circulates between the evaporator and the condenser under low temperature conditions, to be the same as variation in the temperature of refrigerant under normal conditions. Accordingly, embodiments disclosed herein may control the point in time at which the refrigerant reaches the target temperature under low temperature conditions to be the same as the point in time $t_1$ when the refrigerant reaches the target temperature under normal conditions.

When the point in time at which the refrigerant reaches the target temperature under low temperature conditions is equal to the point in time $t_1$ when the refrigerant reaches the target temperature under normal conditions, the frequency of the alternating current supplied to the compressor under low temperature conditions may be higher than the frequency of the alternating current supplied to the compressor under normal conditions. Accordingly, the time $t_{22}$ taken to reduce the frequency of the alternating current supplied to the compressor under low temperature conditions to the second frequency may be longer than the time $t_2$ taken to reduce the temperature of the refrigerant under normal conditions to the second frequency. To make the time $t_2$ be the same as the time $t_{22}$, the reduction rate of the frequency under low temperature conditions may be set to be greater than the reduction rate of the frequency under normal conditions. This has the effect of making the time taken for the drying course under low temperature conditions be the same as the time taken for the drying course under normal conditions, but may disadvantageously cause noise or vibration of the compressor.

When the laundry treatment apparatus is operating under high temperature conditions, the rate of increase of the temperature of the refrigerant (represented by $L_2$), that is, the difference between the two temperatures of the refrigerant measured at different times with the first reference time interval, may be greater than the rate of increase of the temperature under normal conditions. In this case, in embodiments disclosed herein, at least one adjustment may be performed until the two temperatures of the refrigerant measured at different times reach reference values.

That is, embodiments disclosed herein may reduce the frequency of the alternating current supplied to the compressor to a value $R_2$ so as to control variation in the temperature of refrigerant, which circulates between the evaporator and the condenser under high temperature conditions, to be the same as the temperature of refrigerant under normal conditions. Accordingly, embodiments disclosed herein may control the point in time at which the refrigerant reaches the target temperature under high temperature conditions to be the same as the point in time $t_1$ when the refrigerant reaches the target temperature under normal conditions.

When the point in time at which the refrigerant reaches the target temperature under high temperature conditions is equal to the point in time $t_1$ when the refrigerant reaches the target temperature under normal conditions, the frequency of the alternating current supplied to the compressor under high temperature conditions may be higher than the frequency of the alternating current supplied to the compressor under normal conditions. Accordingly, the time $t_{21}$ taken to reduce the frequency of alternating current supplied to the compressor under high temperature conditions to the second frequency may be shorter than the time $t_2$ taken to reduce the temperature of the refrigerant under normal conditions to the second frequency.

Therefore, the drying course performed under high temperature conditions may require less time than the drying course performed under normal conditions. To make the implementation times of the two drying courses be equal to each other (to make the time $t_2$ be the same as the time $t_{21}$), the rate of reduction of the frequency under high temperature conditions may be set to be smaller than the rate of reduction of the frequency under normal conditions.

As is apparent from the above description, embodiments disclosed herein provide a method for controlling a laundry treatment apparatus capable of drying laundry within a constant drying time regardless of a temperature around the laundry treatment apparatus. That is, embodiments disclosed herein prevent the drying time from being increased by allowing air having a temperature suitable for drying laundry to be supplied to a laundry receiving unit or receiver at a constant point in time.

In addition, embodiments disclosed herein provide a method for controlling a laundry treatment apparatus capable of controlling the time taken for refrigerant to reach a target temperature by actively adjusting a flow rate of refrigerant based on a surrounding temperature around the laundry treatment apparatus. Further, embodiments disclosed herein provide a method for controlling a laundry treatment apparatus capable of ensuring that a constant time is taken to raise a temperature of refrigerant to a predetermined temperature range regardless of a surrounding temperature.

Furthermore, embodiments disclosed herein provide a method for controlling a laundry treatment apparatus capable of ensuring that a constant time is taken for air, which is supplied to laundry, to reach a predetermined temperature range. Also, embodiments disclosed herein provide a method for controlling a laundry treatment apparatus capable of reducing the drying time of the laundry treatment apparatus which is operating under low temperature conditions.

Additionally, embodiments disclosed herein provide a method for controlling a laundry treatment apparatus capable of stably controlling a heat exchange cycle by controlling revolutions per minute of a compressor, that is, controlling a frequency of alternating current supplied to the compressor, based on a temperature of refrigerant discharged from the compressor.

Further, embodiments disclosed herein provide a method for controlling a laundry treatment apparatus capable of controlling a variation in the temperature of a refrigerant, when the refrigerant circulates under high temperature or low temperature conditions, to be the same as a variation in the temperature of refrigerant, when the refrigerant circulates under normal conditions, within a short time.

Accordingly, embodiments disclosed herein are directed to a laundry treatment apparatus and a method for controlling a laundry treatment apparatus that substantially obviate one or more problems due to limitations and disadvantages of the related art.

Embodiments disclosed herein provide a laundry treatment apparatus and a method for controlling a laundry treatment apparatus, which are capable of drying laundry within a constant drying time regardless of a surrounding temperature, given that a quantity of laundry is the same. Further, embodiments disclosed herein provide a laundry treatment apparatus and a method for controlling a laundry treatment apparatus capable of controlling a time taken for refrigerant to reach a target temperature by actively adjusting a flow rate of the refrigerant based on a temperature around the laundry treatment apparatus. Furthermore, embodiments disclosed herein provide a method for controlling a laundry treatment apparatus capable of ensuring that a constant time is taken to raise a temperature of refrigerant to a predetermined temperature range regardless of a surrounding temperature.

Also, embodiments disclosed herein provide a method for controlling a laundry treatment apparatus, which is capable of ensuring that a constant time is taken for air, which is supplied to laundry, to reach a predetermined temperature range. Additionally, embodiments disclosed herein provide a method for controlling a laundry treatment apparatus capable of reducing the drying time of the laundry treatment apparatus which is operating under low temperature conditions.

Further, embodiments disclosed herein provide a method for controlling a laundry treatment apparatus capable of stably controlling a heat exchange cycle by controlling revolutions per minute of a compressor by controlling a frequency of alternating current supplied to the compressor based on the temperature of refrigerant discharged from the compressor. Furthermore, embodiments disclosed herein provide a method for controlling a laundry treatment apparatus capable of controlling variation in the temperature of refrigerant, when the refrigerant circulates under high temperature or low temperature conditions, to be the same as a variation in the temperature of refrigerant, when the refrigerant circulates under normal conditions, within a short time.

Embodiments disclosed herein provide a method for controlling a laundry treatment apparatus. The laundry treatment apparatus may include a receiving unit or receiver configured to receive a drying object or object to be dried, a circulation flow path configured to draw interior air of the receiving unit and to resupply the air to the receiving unit, an evaporator configured to evaporate refrigerant via heat exchange with the air introduced to the circulation flow path, a condenser configured to condense the refrigerant via heat exchange with the air having passed through the evaporator, and a compressor configured to compress the refrigerant discharged from the evaporator and supply the compressed refrigerant to the condenser and to control a flow rate of the refrigerant via adjustment of a frequency of alternating current. The method may include a first driving step of supplying alternating current to the compressor at a predetermined first frequency, a primary temperature measurement step of measuring a temperature of the refrigerant discharged from the compressor, a secondary temperature measurement step of measuring a temperature of the refrigerant discharged from the compressor when a predetermined first reference time has passed after implementation of the primary temperature measurement step, and a primary adjustment step of maintaining or changing the first frequency of alternating current based on a difference between the temperature measured in the secondary temperature measurement step and the temperature measured in the primary temperature measurement step.

The primary adjustment step may be performed when the temperature of the refrigerant measured in the secondary temperature measurement step is below a predetermined target temperature. The change of the first frequency in the primary adjustment step may be performed when the temperature of the refrigerant measured in the secondary temperature measurement step is below a predetermined target temperature.

The method may further include a second driving step of supplying alternating current to the compressor at a second frequency when the temperature of the refrigerant measured in the secondary temperature measurement step is the target temperature or higher, the second frequency being set to be lower than the first frequency. The primary adjustment step may include supplying the alternating current to the compressor at the first frequency when a difference between the temperature measured in the secondary temperature measurement step and the temperature measured in the primary temperature measurement step is equal to a predetermined reference value.

When the difference between the temperature measured in the secondary temperature measurement step and the temperature measured in the primary temperature measurement step is equal to the predetermined reference value, it can be seen that the laundry treatment apparatus is operating under normal conditions, that is, in a state in which a rate of increase of the temperature of the refrigerant corresponds to a target rate of increase of the temperature of the refrigerant. That is, as the rate of increase of the temperature of the refrigerant for increasing the temperature of air supplied to laundry to a temperature range suitable for laundry drying is equal to a reference temperature increase rate, the temperature of the refrigerant may be increased to a target temperature within a target time even when the frequency of alternating current supplied to the compressor is maintained at the first frequency.

The primary adjustment step may include supplying alternating current to the compressor at a frequency higher than the first frequency when the difference between the temperature measured in the secondary temperature measurement step and the temperature measured in the primary temperature measurement step is smaller than the predetermined reference value. When the difference between the temperature measured in the secondary temperature measurement step and the temperature measured in the primary temperature measurement step is smaller than the predetermined reference value, it can be seen that the laundry treatment apparatus is operating under low temperature conditions, that is, at a temperature lower than normal. That is, the rate of increase of the temperature of the refrigerant is smaller than the rate of increase of the temperature under normal conditions. In this case, the primary adjustment step may include supplying alternating current to the compressor at a frequency higher than the first frequency to increase the RPM of the compressor.

When the RPM of the compressor increases, a speed of movement of the refrigerant circulating between the evaporator and the condenser becomes greater than that under normal conditions, which increases the flow rate of the refrigerant introduced to the evaporator. This consequently will increase the rate of increase of the temperature of the refrigerant which is heated by passing through the evaporator. Through this process, the rate of increase of the temperature of the refrigerant will, within a short time, be made equal to the rate of increase of the temperature under normal conditions.

The primary adjustment step may include supplying alternating current to the compressor at a frequency higher than the second frequency and lower than the first frequency when the difference between the temperature measured in the secondary temperature measurement step and the temperature measured in the primary temperature measurement step is greater than the predetermined reference value. When the difference between the temperature measured in the secondary temperature measurement step and the temperature measured in the primary temperature measurement step is greater than the predetermined reference value, it can be seen that the laundry treatment apparatus is operating under high temperature conditions, that is, at a temperature higher than normal. That is, the rate of increase of the temperature of the refrigerant is greater than the rate of increase of the temperature under normal conditions. In this case, the primary adjustment step may include supplying alternating current to the compressor at a frequency lower than the first frequency to reduce the RPM of the compressor.

When the RPM of the compressor is reduced, the speed of movement of the refrigerant circulating between the evaporator and the condenser becomes smaller than that under normal conditions, which reduces the flow rate of the refrigerant introduced to the evaporator. This consequently will reduce the rate of increase of the temperature of the refrigerant which is heated by passing through the evaporator. Through this process, the rate of increase of the temperature of the refrigerant will, within a short time, be made equal to the rate of increase of the temperature under normal conditions.

The method according to embodiments disclosed herein may further include a tertiary temperature measurement step of measuring a temperature of the refrigerant discharged from the compressor when a predetermined second reference time has passed after completion of the secondary temperature measurement step when the temperature of the refrigerant measured in the secondary temperature measurement step is below the target temperature, and a secondary adjustment step of adjusting a frequency of alternating current supplied to the compressor based on a difference between the temperature measured in the tertiary temperature measurement step and the temperature measured in the secondary temperature measurement step. The secondary adjustment step may include supplying alternating current to the compressor at a frequency increased by a predetermined reference frequency from the frequency set after implementation of the primary adjustment step when the difference between the temperature measured in the tertiary temperature measurement step and the temperature measured in the secondary temperature measurement step is smaller than a predetermined reference value.

When the difference between the temperature measured in the tertiary temperature measurement step and the temperature measured in the secondary temperature measurement step is smaller than a predetermined reference value, this means that the rate of increase of the temperature of the refrigerant is smaller than the rate of increase of the temperature under normal conditions despite implementation of the primary adjustment step. Accordingly, the secondary adjustment step may be a step of additionally increasing the frequency of alternating current supplied to the compressor so as to additionally increase the rate of increase of the temperature of the refrigerant.

The secondary adjustment step may include supplying alternating current to the compressor at a frequency reduced by a predetermined reference frequency from the frequency set after implementation of the primary adjustment step when the difference between the temperature measured in the tertiary temperature measurement step and the temperature measured in the secondary temperature measurement step is greater than a predetermined reference value. When the difference between the temperature measured in the tertiary temperature measurement step and the temperature measured in the secondary temperature measurement step is greater than the predetermined reference value, this means that the rate of increase of the temperature of the refrigerant after implementation of the primary adjustment step is greater than the rate of increase of the temperature under normal conditions. Accordingly, the secondary adjustment step may be a step of reducing the frequency of alternating current supplied to the compressor so as to reduce the rate of increase of the temperature of the refrigerant.

The secondary adjustment step may include supplying alternating current to the compressor at the frequency set after implementation of the primary adjustment step when the difference between the temperature measured in the tertiary temperature measurement step and the temperature measured in the secondary temperature measurement step is equal to the predetermined reference value. When the difference between the temperature measured in the tertiary temperature measurement step and the temperature measured in the secondary temperature measurement step is equal to the predetermined reference value, this means that the rate of increase of the temperature of the refrigerant corresponds to the rate of increase of the temperature under normal conditions. Accordingly, the secondary adjustment step may be a step of continuously supplying alternating current to the compressor at the frequency adjusted via the primary adjustment step so as to increase the temperature of the refrigerant to a target temperature.

The method according to embodiments disclosed herein may further include a second driving step of supplying alternating current to the compressor at a second frequency when the temperature of the refrigerant measured in the secondary temperature measurement step is the target temperature or higher or when the temperature of the refrigerant measured in the tertiary temperature measurement step is the target temperature or higher, the second frequency being set to be lower than the first frequency. The method according to embodiments disclosed herein may further include a step of supplying alternating current to the compressor at a frequency higher than the first frequency before implementation of the secondary temperature measurement step when the temperature of the refrigerant measured in the primary temperature measurement step is a predetermined first temperature or lower.

Embodiments disclosed herein provide a laundry treatment apparatus that may include a receiving unit or receiver configured to receive a drying object or object to be dried, a circulation flow path configured to draw interior air of the receiving unit and to resupply the air to the receiving unit, an evaporator configured to evaporate refrigerant via heat exchange with the air introduced to the circulation flow path, a condenser configured to condense the refrigerant via heat exchange with the air having passed through the evaporator, a compressor configured to compress the refrigerant discharged from the evaporator and supply the compressed refrigerant to the condenser and to control a flow rate of the refrigerant via adjustment of a frequency of alternating current, a temperature sensor configured to measure a temperature of the refrigerant discharged from the compressor, and a controller configured to maintain or change a frequency of alternating current supplied to the compressor based on the temperature of the refrigerant measured via the temperature sensor. The controller may increase the frequency of alternating current supplied to the compressor by a predetermined reference frequency when a difference between at least two temperatures of the refrigerant measured via the temperature sensor is smaller than a predetermined reference value. The controller may reduce the frequency of alternating current supplied to the compressor by a predetermined reference frequency when a difference between at least two temperatures of the refrigerant measured via the temperature sensor is greater than a predetermined reference value.

Embodiments disclosed herein provide a control method of a laundry treatment apparatus, the laundry treatment apparatus including a receiving unit or receiver configured to receive a drying object, a circulation flow path configured to draw interior air of the receiving unit and to resupply the air to the receiving unit, an evaporator configured to evaporate refrigerant via heat exchange with the air introduced to the circulation flow path, a condenser configured to condense the refrigerant via heat exchange with the air having passed through the evaporator, and a compressor configured to compress the refrigerant discharged from the evaporator and supply the compressed refrigerant to the condenser and to control the flow rate of the compressed refrigerant via adjustment of a frequency of alternating current. The method may include a first driving step of supplying alternating current to the compressor at a predetermined first frequency, a primary temperature measurement step of measuring a temperature of the refrigerant discharged from the compressor, a secondary temperature measurement step of measuring a temperature of the refrigerant discharged from the compressor when a predetermined first reference time has passed after completion of the primary temperature measurement step, and a control step of controlling, maintaining, or changing the first frequency of alternating current based on a difference between the temperature measured in the secondary temperature measurement step and the temperature measured in the primary temperature measurement step.

The control step may include continuously supplying the first frequency of alternating current to the compressor when the difference between the temperature measured in the secondary temperature measurement step and the temperature measured in the primary temperature measurement step is equal to a predetermined reference value. The control step may include a primary adjustment step of changing the first frequency when a difference between the temperature measured in the secondary temperature measurement step and the temperature measured in the primary temperature measurement step is not equal to a predetermined reference value.

The control method may further include a second driving step of supplying alternating current to the compressor at a second frequency when the difference between the temperature measured in the secondary temperature measurement step and the temperature measured in the primary temperature measurement step is equal to a predetermined reference value is equal to the reference value and the temperature measured in the secondary temperature measurement step is a predetermined target temperature or higher, the second frequency being set to be lower than the first frequency.

A case in which the difference between the temperature measured in the secondary temperature measurement step and the temperature measured in the primary temperature measurement step is equal to the reference value means a case in which a rate of increase of the temperature of the refrigerant corresponds to a predetermined condition. That is, this case means that the laundry treatment apparatus is operating under normal conditions. That the temperature of the refrigerant measured in the secondary temperature measurement step is the predetermined target temperature or higher means that a temperature of air heated by the refrigerant may be increased to a temperature suitable for drying laundry.

The primary adjustment step may include supplying alternating current to the compressor at a frequency higher than the first frequency when the difference between the temperature measured in the secondary temperature measurement step and the temperature measured in the primary temperature measurement step is smaller than the reference value. A case in which a difference between the temperature measured in the secondary temperature measurement step and the temperature measured in the primary temperature measurement step is smaller than the reference value means that the laundry treatment apparatus is operating under low temperature conditions, that is, at a temperature lower than room temperature.

The primary adjustment step may include supplying alternating current to the compressor at a frequency lower than the first frequency and higher than the second frequency when the difference between the temperature measured in the secondary temperature measurement step and the temperature measured in the primary temperature measurement step is greater than the reference value. A case in which the difference between the temperature measured in the secondary temperature measurement step and the temperature measured in the primary temperature measurement step is greater than the reference value means that the laundry treatment apparatus is operating under high temperature conditions, that is, at a temperature higher than room temperature. Accordingly, the control method according to embodiments disclosed herein may proceed to the primary adjustment step to make the rate of increase of the temperature of the refrigerant be the same as the rate of increase of the temperature under normal conditions.

The control method may further include a tertiary temperature measurement step of measuring a temperature of the refrigerant discharged from the compressor after completion of the primary adjustment step. The control method may further include a step of continuously supplying alternating current to the compressor at a frequency changed via the primary adjustment step when a difference between the temperature measured in the secondary temperature measurement step and the temperature measured in the tertiary temperature measurement step is equal to the reference value.

The control method may further include a second driving step of supplying alternating current to the compressor at a second frequency when the difference between the temperature measured in the secondary temperature measurement step and the temperature measured in the tertiary temperature measurement step is equal to the reference value and when the temperature of the refrigerant measured in the tertiary temperature measurement step is a predetermined target temperature or higher, the second frequency being set to be lower than the first frequency. The control method may further include a secondary adjustment step of supplying alternating current to the compressor at a frequency higher than the frequency of alternating current adjusted via the primary adjustment step when the temperature measured in the tertiary temperature measurement step and the temperature measured in the secondary temperature measurement step is smaller than the reference value.

The control method may further include a secondary adjustment step of supplying alternating current to the compressor at a frequency lower than the frequency of alternating current adjusted via the primary adjustment step and higher than the second frequency when a difference between the temperature measured in the tertiary temperature measurement step and the temperature measured in the secondary temperature measurement step is greater than the reference value. The control method may further include a step of supplying alternating current to the compressor at a frequency higher than the first frequency before implementation of the secondary temperature measurement step when the temperature of the refrigerant measured in the primary temperature measurement step is a predetermined first temperature or lower.

Embodiments disclosed herein have a feature in that the adjustment step as described above may be performed several times until the refrigerant reaches a target temperature, in order to make the rate of increase of the temperature of the refrigerant be the same as the rate of increase of the temperature under normal conditions. That is, according to embodiments disclosed herein may achieve the same time taken for the refrigerant to reach a target temperature regardless of the operating temperature conditions of the laundry treatment apparatus.

Embodiments disclosed herein provide a laundry treatment apparatus that may include a receiving unit or receiver configured to receive a drying object, a circulation flow path configured to draw interior air of the receiving unit and to resupply the air to the receiving unit, an evaporator configured to evaporate refrigerant via heat exchange with the air introduced to the circulation flow path, a condenser configured to condense the refrigerant via heat exchange with the air having passed through the evaporator, a compressor configured to compress the refrigerant discharged from the evaporator and supply the compressed refrigerant to the condenser and to control the flow rate of the refrigerant via adjustment of a frequency of alternating current, a temperature sensor configured to measure a temperature of the refrigerant discharged from the compressor, and a controller configured to maintain or change a frequency of alternating current supplied to the compressor based on the temperature of the refrigerant measured via the temperature sensor. The controller may increase the frequency of the alternating current supplied to the compressor by a predetermined reference frequency when a difference between two temperatures of the refrigerant measured at different times via the temperature sensor is smaller than a predetermined reference value.

The controller may reduce the frequency of alternating current supplied to the compressor by the predetermined reference frequency when the difference between the two temperatures of the refrigerant measured at different times via the temperature sensor is greater than the predetermined reference value. The controller may maintain the frequency of the alternating current supplied to the compressor when the difference between the two temperatures of the refrigerant measured at different times via the temperature sensor is equal to the predetermined reference value.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a laundry treatment apparatus, the laundry treatment apparatus comprising a receiver that receives an object to be dried, a circulation flow path that draws air out of the receiver and resupplies the air into the receiver, an evaporator that evaporates a refrigerant via heat exchange with the air introduced to the circulation flow path, a condenser that condenses the refrigerant via heat exchange with the air having passed through the evaporator, and a compressor that compresses the refrigerant discharged from the evaporator and supplies the compressed refrigerant to the condenser, and a controller that controls a flow rate of the compressed refrigerant via adjustment of a frequency of alternating current supplied to the compressor, the method comprising:

supplying alternating current to the compressor at a predetermined first frequency;

measuring a first time a temperature of the refrigerant discharged from the compressor;

measuring a second time a temperature of the refrigerant discharged from the compressor when a predetermined first reference time has passed after completion of the measuring the first time the temperature of the refrigerant discharged from the compressor; and controlling the first frequency of the alternating current based on a difference between the temperature measured the first time and the temperature measured the second.

2. The method according to claim 1, wherein the controlling includes continuously supplying the first frequency of the alternating current to the compressor when the difference between the temperature measured the second time and the temperature measured the first time is equal to a predetermined reference value.

3. The method according to claim 2, further including supplying the alternating current to the compressor at a second frequency when the temperature of the refrigerant measured the second time is greater than or equal to a predetermined target temperature, the second frequency being set to be lower than the first frequency.

4. The method according to claim 1, wherein the controlling includes changing the first frequency when a difference between the temperature measured the second time and the temperature measured the first time is not equal to a predetermined reference value.

5. The method according to claim 4, wherein the changing the first frequency includes supplying the alternating current to the compressor at a frequency higher than the first frequency when the difference between the temperature measured the second time and the temperature measured the first time is less than the predetermined reference value.

6. The method according to claim 4, wherein the changing the first frequency includes supplying the alternating current to the compressor at a frequency lower than the first frequency when the difference between the temperature measured the second time and the temperature measured the first time is eater than the predetermined reference value.

7. The method according to claim 4, further including measuring a third time a temperature of the refrigerant discharged from the compressor after completion of the changing of the first frequency.

8. The method according to claim 7, further including supplying the alternating current to the compressor at a frequency changed via the changing of the first frequency when a difference between the temperature measured the third time and the temperature measured the second time is equal to the predetermined reference value.

9. The method according to claim 8, further including supplying the alternating current to the compressor at a second frequency when the temperature of the refrigerant measured the third time is equal to or greater than a predetermined target temperature, the second frequency being set to be lower than the first frequency.

10. The method according to claim 7, further including supplying the alternating current to the compressor at a frequency higher than the frequency of the alternating current changed via the changing of the first frequency when the temperature measured the third time and the temperature measured the second time is less than the predetermined reference value.

11. The method according to claim 7, further including supplying the alternating current to the compressor at a frequency lower than the frequency of the alternating current changed via the changing of the first frequency when a difference between the temperature measured the third time and the temperature measured the second time is greater than the predetermined reference value.

12. The method according to claim 1, further including supplying the alternating current to the compressor at a frequency higher than the first frequency when the temperature of the refrigerant measured the first time is less than a predetermined first temperature.

* * * * *